US007238071B2

(12) United States Patent
Takada et al.

(10) Patent No.: US 7,238,071 B2
(45) Date of Patent: Jul. 3, 2007

(54) OUTBOARD MOTOR CONTROL SYSTEM

(75) Inventors: Hideaki Takada, Wako (JP); Hiroshi Watabe, Wako (JP); Hiroshi Mizuguchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 83 days.

(21) Appl. No.: 11/174,749

(22) Filed: Jul. 5, 2005

(65) Prior Publication Data

US 2006/0009096 A1 Jan. 12, 2006

(30) Foreign Application Priority Data

Jul. 6, 2004 (JP) ..... 2004-199090

(51) Int. Cl.
*B60W 10/04* (2006.01)
*B63H 21/21* (2006.01)

(52) U.S. Cl. ..... 440/84; 440/86; 440/87

(58) Field of Classification Search ..... None
See application file for complete search history.

(56) References Cited

U.S. PATENT DOCUMENTS 6,855,020 B2 * 2/2005 Kaji ..... 440/84
6,863,580 B2 * 3/2005 Okuyama ..... 440/1
6,964,591 B2 * 11/2005 Takada et al. ..... 440/86

FOREIGN PATENT DOCUMENTS

JP 2808636 7/1998

* cited by examiner

*Primary Examiner*—Jesus Sotelo
*Assistant Examiner*—Daniel V Venne
(74) *Attorney, Agent, or Firm*—Carrier, Blackman & Associates, P.C.; Joseph P. Carrier; William D. Blackman

(57) ABSTRACT

In an outboard motor control system equipped with an electric throttle motor for moving the throttle valve of the engine mounted on the outboard motor, an electric shift motor for operating the shift mechanism to establish one from the in-gear, neutral and reverse shift positions, and a low-speed cruising switch for inputting the instruction to implement a low-speed cruising for causing the boat to cruise at a low speed, when the instruction is inputted, a throttle control is effected by controlling the operation of the motor to a set throttle opening and shift control is effected by controlling the operation of the motor to establish the in-gear position and neutral position alternatively, thereby enabling to cruise over a wide range of speeds including very slow, without requiring troublesome manual operations.

8 Claims, 7 Drawing Sheets

OUTBOARD MOTOR CONTROL SYSTEM

BACKGROUND OF THE INVENTION

1. Field of the Invention

This invention relates to an outboard motor control system, particularly to an outboard motor control system configured for regulating the speed of a boat.

2. Description of the Related Art

One example of an outboard motor control system capable of controlling the speed of a boat (boat speed) is taught by Japanese Patent 2808636 (e.g., at page 2, from left column, line 50 to right column, line 18). This prior art system prevents engine stalling and increase in boat speed during trolling by advancing or retarding the ignition timing of the engine so as to maintain engine speed constant irrespective of load.

Most outboard motors have only one fixed gear ratio in both the forward and reverse directions. In addition, since the propeller is usually shaped for optimum performance at maximum engine speed, the dead slow boat speed may not be low enough when the outboard motor is kept in-gear.

During very low-speed cruising using a conventional outboard motor, therefore, the operator is required to manually repeat the troublesome operations of shifting from an in-gear position to the neutral position and then shifting back to the in-gear position when the boat speed decreases.

SUMMARY OF THE INVENTION

An object of this invention is therefore to overcome this inconvenience by providing an outboard motor control system that enables cruising over a wide range of speeds including very slow, without requiring troublesome manual operations.

In order to achieve the object, the invention provides a system for controlling an outboard motor mounted on a stern of a boat and having an internal combustion engine and a propeller that is powered by the engine to propel the boat, comprising: a throttle actuator connected to a throttle valve of the engine and moving the throttle valve; a shift actuator connected to a shift mechanism and operating the shift mechanism to establish one from among a neutral position, an in-gear position and a reverse position; an instruction switch enabling an operator to input an instruction to cause the boat to cruise at a low speed; and a control unit controlling operations of the throttle actuator and the shift actuator, when the instruction switch is manipulated by the operator, such that shift position is changed alternatively between the neutral position and the in-gear position.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments o f the outboard motor control system according to the invention will now be explained with reference to the attached drawings.

Figure 1:
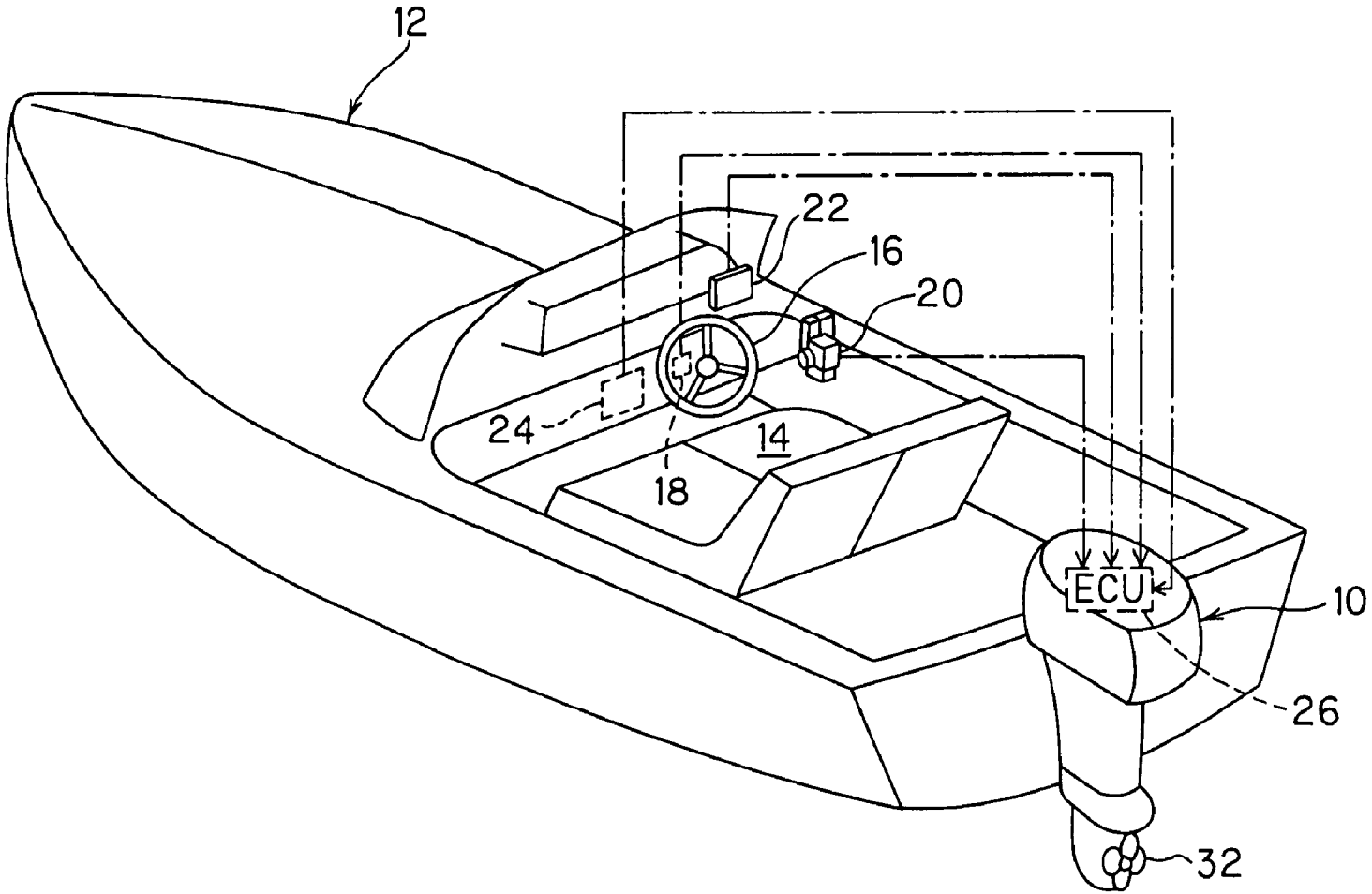
FIG. 1 is an overall schematic view of an outboard motor control system according to a first embodiment of the invention.
Figure 2:
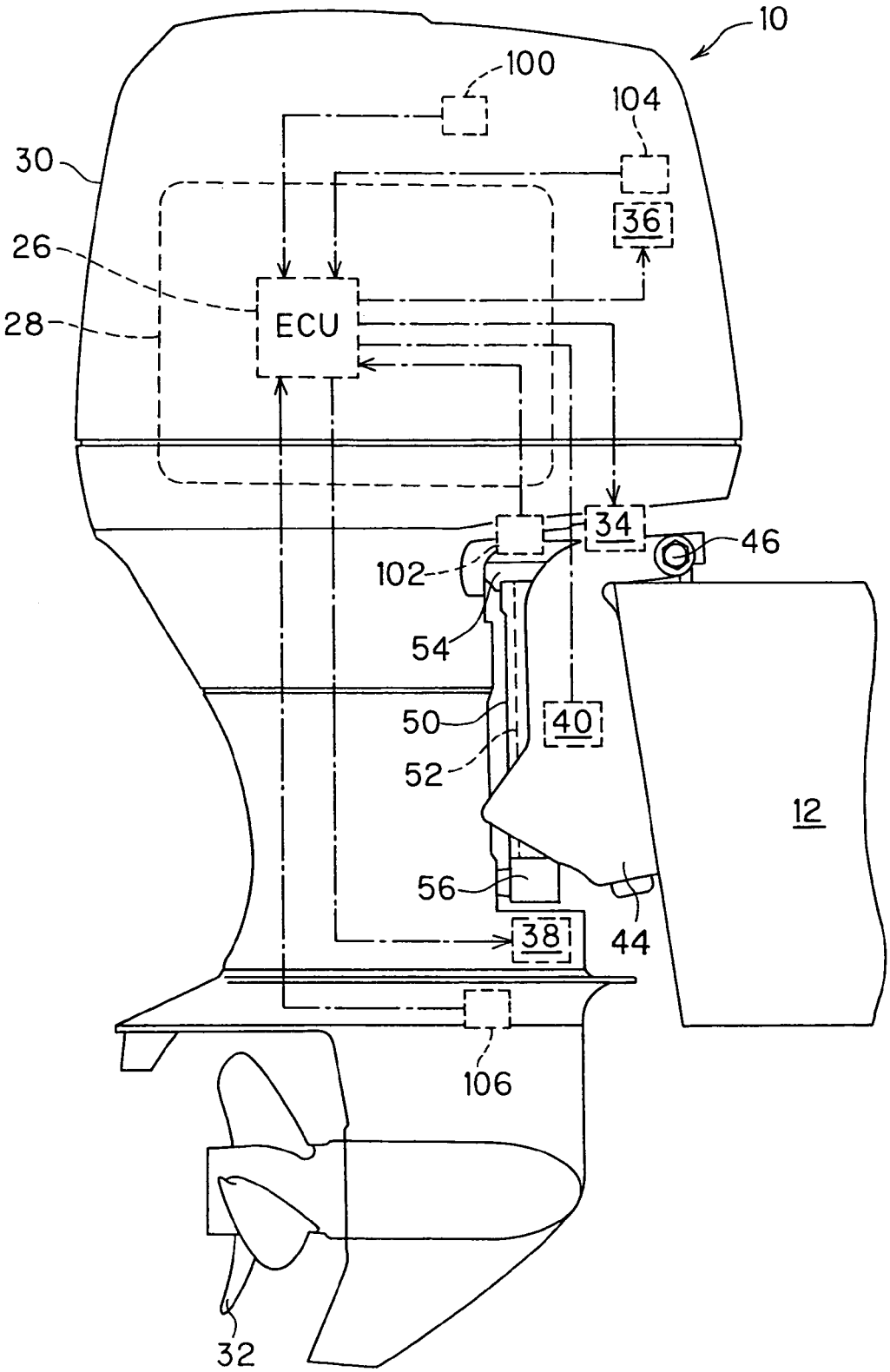
FIG. 2 is a side view of the outboard motor shown in FIG. 1.

FIG. 1 is an overall schematic view of an outboard motor control system including a hull (boat) according to a first embodiment of the invention and FIG. 2 is a side view of the outboard motor shown in FIG. 1.

In FIGS. 1 and 2, the symbol 10 indicates an outboard motor. The outboard motor 10 is mounted on the stern (transom) of a hull (boat) 12.

As shown in FIG. 1, a steering wheel 16 is installed near the operator's seat 14 of the boat 12. A steering wheel angle sensor 18 is installed near a shaft (not shown) of the steering wheel 16 and outputs or generates a signal indicative of the rotation amount (angle) of the steering wheel 16 manipulated by the operator. A remote control box 20 is installed near the operator's seat 14. The remote control box 20 comprises levers and a switch (explained later) that outputs or generates signals in response to the manipulation of the operator.

A GPS (Global Positioning System) 22 and a control panel 24 are further installed near the operator's seat 14. The GPS 22 calculates a wake (the track or course left behind the boat 12 which has passed) and speed of the boat 12 and indicates the calculated results on a display. The control panel 24 is equipped with switches (explained later) that output or generate signals in response to the manipulation of the operator. The above-mentioned outputs are sent to an electronic control unit (hereinafter referred to as "ECU") 26 mounted on the outboard motor 10. The ECU 26 comprises a microcomputer.

As shown in FIG. 2, the outboard motor 10 is equipped with an internal combustion engine (hereinafter referred to as "engine") 28 at its upper portion. The engine 28 is a spark-ignition gasoline engine. The engine 28 is located above the water surface and enclosed by an engine cover 30. The ECU 26 is installed inside or under the engine cover 30 at a location near the engine 28.

The outboard motor 10 is equipped at its lower portion with a propeller 32. The propeller 32 is powered by the engine 28 to operate to propel the boat 12 in the forward and reverse directions.

The outboard motor 10 is further equipped with an electric steering motor (actuator) 34 for steering the outboard motor 10 to the right and left directions, an electric throttle motor (throttle actuator) 36 for opening and closing a throttle valve (not shown in FIG. 2) of the engine 28, an electric shift motor (shift actuator) 38 for operating a shift mechanism (not shown in FIG. 2) to a shift position between in-gear (i.e., forward) and neutral, and a power tilt-trim unit (actuator) 40 for regulating a tilt angle and trim angle of the outboard motor 10.

Figure 3:
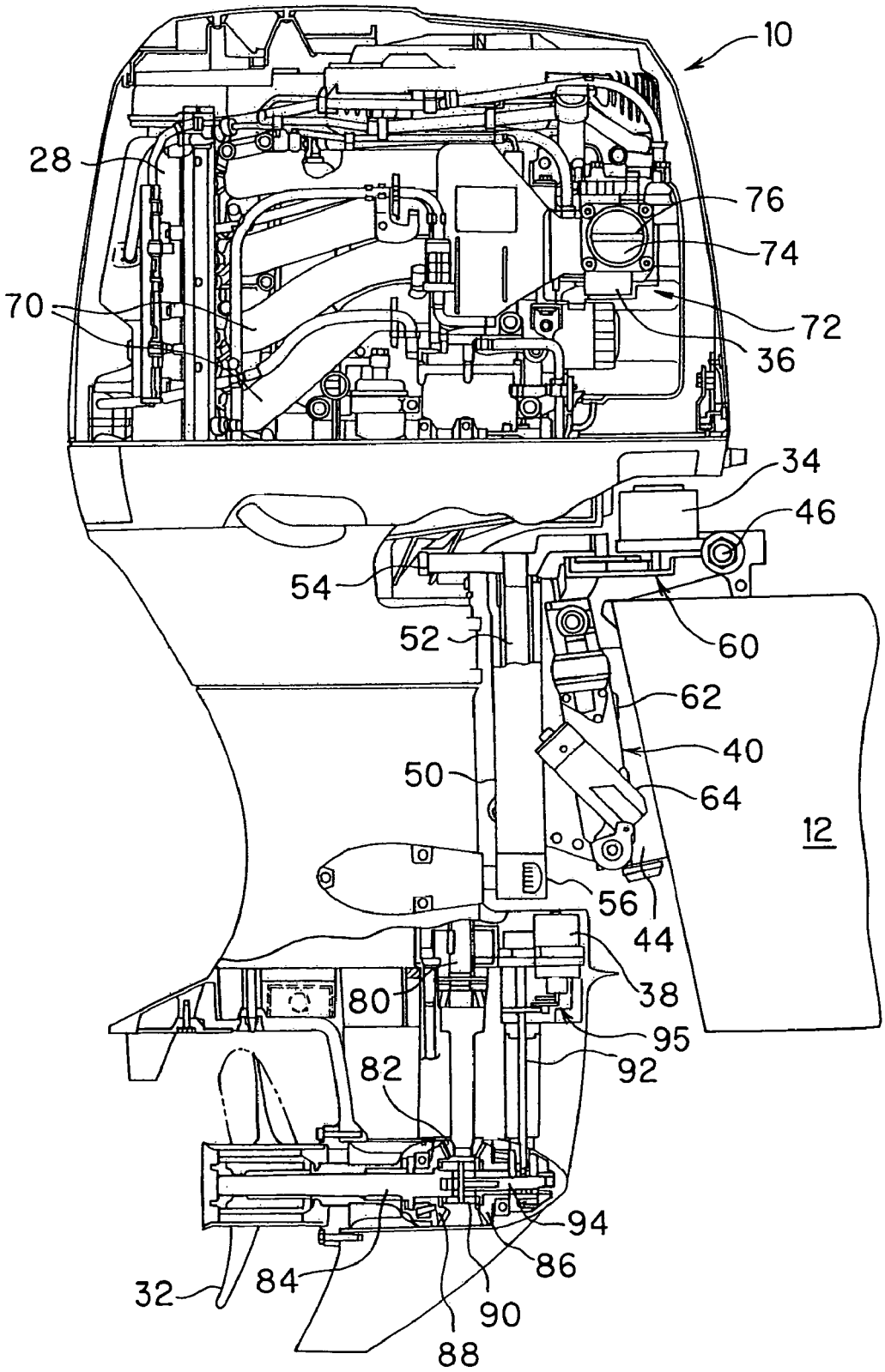
FIG. 3 is a partial sectional diagram of the outboard motor shown in FIG. 2.

The structure of the outboard motor 10 will now be described in detail with reference to FIG. 3. FIG. 3 is a partial sectional diagram of the outboard motor 10.

The outboard motor 10 is equipped with stern brackets 44 fastened to the stern of the boat 12. The stern brackets 44 are comprised of a pair of right and left members that face each other and only the left side thereof in the forward direction is illustrated in FIG. 3. A swivel case 50 is attached to the stern brackets 44 through a tilting shaft 46. The tilting shaft 46 is placed such that its axial direction is parallel with a lateral direction (left and right direction perpendicular to the boat forward direction). Specifically, the swivel case 50 is free to rotate about the lateral axis, i.e., the tilting shaft 46, as a rotational axis with respect to the stern brackets 44.

A swivel shaft 52 is housed in a swivel case 50 to be freely rotated about a vertical axis. The upper end of the swivel shaft 52 is fastened to a mount frame 54 and the lower end thereof is fastened to a lower mount center housing 56. The mount frame 54 and lower mount center housing 56 are fastened to a frame (not shown) constituting a main body of the outboard motor 10.

The upper portion of the swivel case 50 is installed with the electric steering motor 34. The output shaft of the electric steering motor 34 is connected to the mount frame 54 via a speed reduction gear mechanism 60. Specifically, a rotational output generated by driving the electric steering motor 34 is transmitted via the speed reduction gear mechanism 60 to the mount frame 54 such that the outboard motor 10 is steered (rotated) about the swivel shaft 52 as a rotational axis to the right and left directions.

The power tilt-trim unit 40 is installed near the stern brackets 44 and the swivel case 50. The unit 40 integrally comprises one hydraulic cylinder for tilt angle regulation (hereinafter called "tilt hydraulic cylinder") 62 and two hydraulic cylinders for trim angle regulation (only one shown; hereinafter called "trim hydraulic cylinders") 64. The cylinder bottom of the tilt hydraulic cylinder 62 is fastened to the stern brackets 44 and the rod head thereof abuts on the swivel case 50. The cylinder bottom of each trim hydraulic cylinder 64 is fastened to the stem brackets 44 and the rod head thereof abuts on the swivel case 50. Thus, when the tilt hydraulic cylinder 62 or the trim hydraulic cylinders 64 are driven (extend and contract), the swivel case 50 rotates about the tilting shaft 46 as a rotational axis, thereby driving the outboard motor 10 to perform tilt up/down or trim up/down.

The engine 28 has an intake manifold 70 that is connected to a throttle body 72. The throttle body 72 has a throttle valve 74 installed therein and the electric throttle motor 36 is integrally disposed thereto. The output shaft of the electric throttle motor 36 is connected via the speed reduction gear mechanism (not shown) installed near the throttle body 72 with the throttle shaft 76 that supports the throttle valve 74. Specifically, a rotational output generated by driving the electric throttle motor 36 is transmitted to the throttle shaft 76 to open and close the throttle valve 74, thereby regulating an air intake amount of the engine 28 to control the engine speed.

One end (the upper end) of a drive shaft (vertical shaft) 80 is connected to a crankshaft (not shown) of the engine 28. As illustrated, the drive shaft 80 has its rotational axis oriented in parallel with the vertical axis, such that the drive shaft 80 is driven by the output of the engine 28 to rotate about the vertical axis. The other end (the lower end) of the drive shaft 80 is equipped with a pinion gear 82.

The propeller 32 is attached to a propeller shaft 84 that is free to rotate about a horizontal axis (more specifically, an axis in parallel with the boat forward direction). A forward bevel gear 86 and a reverse bevel gear 88, which mesh with the pinion gear 82 and rotate in the opposite directions from each other, are rotatably supported on the outer circumference of the propeller shaft 84.

A clutch 90 is installed between the forward bevel gear 86 and reverse bevel gear 88 and attached to the propeller shaft 84. By manipulating a shift rod 92 to slide a shift slider 94, the clutch 90 can be brought into engagement with one of the forward bevel gear 86 and the reverse bevel gear 88. A shift mechanism of the outboard motor 10 comprises the clutch 90, shift rod 92 and shift slider 94.

The upper portion of the shift rod 92 is installed with the electric shift motor 38. The output shaft of the electric shift motor 38 is connected to the shift rod 92 via a speed reduction gear mechanism 95. Thus, by driving the electric shift motor 38, the shift rod 92 rotates to slide the shift slider 94, thereby enabling the clutch 90 to engage with the forward bevel gear 86 (i.e., in-gear) or the reverse bevel gear 88.

The rotation of the drive shaft 80 is converted to rotation about the horizontal axis via the pinion gear 82 and bevel gears 86, 88 and transmitted to the propeller shaft 84 via the clutch 90 engaged with one of the bevel gears 86, 88, such that the propeller 32 is rotated either in the direction for propelling the boat 12 forward or the direction for propelling it rearward.

By driving the electric shift motor 38 to slide the shift slider 94, the engagement of the clutch 90 and either of the bevel gears 86, 88 can also be released or disengaged. Thus, with the driving of the electric shift motor 38 for operating the shift mechanism, the shift position can be controlled to the in-gear (forward) position or neutral position.

The explanation of FIG. 2 will be resumed.

A crank angle sensor 100 is installed near the crankshaft of the engine 28 inside the outboard motor 10. The crank angle sensor 100 outputs or generates a crank angle signal every predetermined crank angle (e.g., 30 degrees). A steering angle sensor 102 is also installed near the swivel shaft 52 and outputs or generates a signal indicative of a steering angle of the outboard motor 10 (i.e., rotation angle of the swivel shaft 52).

A throttle opening sensor 104 is installed near the electric throttle motor 36 and outputs or generates a signal indicative of the opening or position of the throttle valve 74. Further, a shift position sensor 106 is installed near the electric shift motor 38 and outputs or generates a signal indicative of a rotation angle of the electric shift motor 38.

The outputs of the foregoing sensors 100, 102, 104 and 106 are sent to the ECU 26. The ECU 26 detects (calculates) the engine speed by counting the outputs from the crank angle sensor 100 and also detects the shift position based on the outputs from the shift position sensor 106. Further the ECU 26 controls the operations of electric steering motor 34, electric throttle motor 36, electric shift motor 38 and power tilt-trim unit 40 based on the outputs from the sensors 100, 102, 104 and 106 and the outputs from the steering wheel angle sensor 18 and the control panel 24.

Figure 4:
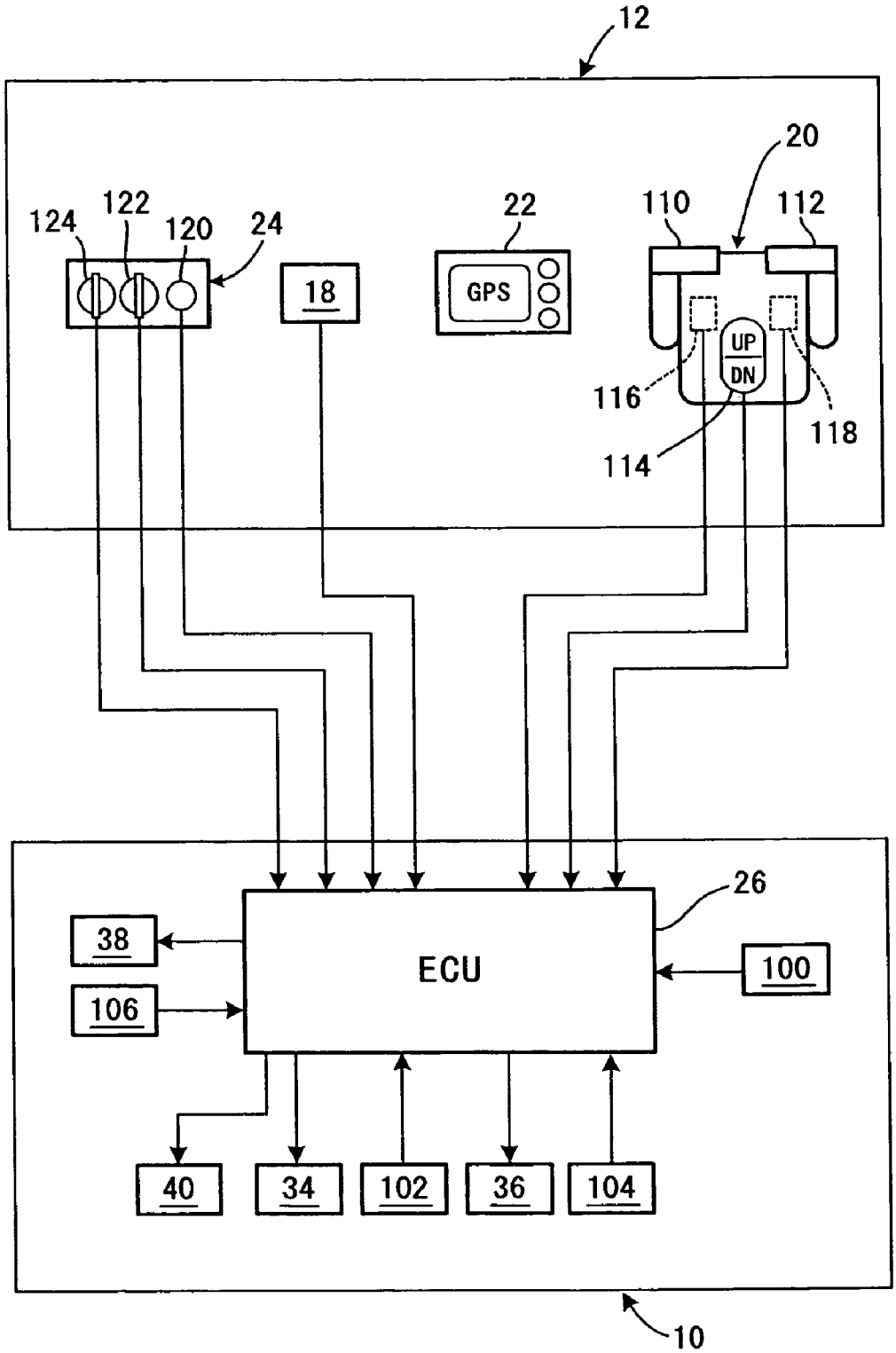
FIG. 4 is a block diagram showing the structure of the system shown in FIG. 1.

FIG. 4 is a block diagram showing the configuration of an outboard motor control system according to the first embodiment of this invention.

As shown in FIG. 4, the remote control box 20 is equipped with a throttle lever 110, shift lever 112 and power tilt-trim switch 114. A throttle lever position sensor 116 installed near the throttle lever 110 outputs or generates a signal corresponding to the position to which the operator moves throttle lever 110.

A shift lever position sensor 118 installed near the shift lever 112 outputs or generates a signal corresponding to the position to which the operator moves the shift lever 112. The power tilt-trim switch 114 outputs or generates a signal corresponding to the tilt up/down and trim up/down commands inputted by the operator. The outputs of the power tilt-trim switch 114, throttle lever position sensor 116 and shift lever position sensor 118 are sent to the ECU 26.

The ECU 26 determines a desired throttle opening in response to the output of the throttle lever position sensor 116 and controls the operation of the electric throttle motor 36 to make the throttle opening value detected by the throttle opening sensor 104 equal to the desired throttle opening.

The ECU 26 also determines a desired rotation angle of the electric shift motor 38 (the rotation angle of the shift rod 92, i.e., a desired shift position) in response to the output of the shift lever position sensor 118 and controls the operation of the electric shift motor 38 to make the value detected by the shift position sensor 106 equal to the desired rotation angle. Further, the ECU 26 determines a desired steering angle (rotation angle of the swivel shaft 52) of the outboard motor 10 based on the output of the steering wheel angle sensor 18 and controls the operation of the electric steering motor 34 to make the steering angle detected by the steering angle sensor 102 equal to the desired steering angle.

In addition, the ECU 26 controls the operation of the power tilt-trim unit 40 in response to the output of the power tilt-trim switch 114. The power tilt-trim switch 114 is a rocker switch comprising an up-switch (designated UP in the drawing) and down-switch (designated DN). When the up-switch is pressed, the ECU 26 operates the tilt hydraulic cylinder 62 and trim hydraulic cylinders 64 to extend their rods and produce a tilt-up or trim-up action, and when the down-switch is pressed, it operates the tilt hydraulic cylinder 62 and trim hydraulic cylinders 64 to retract their rods and produce a tilt-down or trim-down action.

As shown in FIG. 4, the control panel 24 is installed with a low-speed cruising switch (instruction switch) 120 for enabling the operator to input an instruction to implement a low-speed cruising for causing the boat 12 to cruise at a low speed, a shift change period setting switch (dial switch) 122 for enabling the operator to set a time period of changing or switching the shift position (explained later) at the low-speed cruising and outputting a signal corresponding to the switch position manipulated by the operator (i.e., the position dialed by the operator), and a throttle opening setting switch (dial switch) 124 for enabling the operator to set a desired throttle opening at the low-speed cruising and outputting a signal corresponding to the switch position manipulated by the operator (i.e., the position dialed by the operator).

When operated or manipulated by the operator, the low-speed cruising switch 120 outputs a signal indicating that the instruction to implement the low-speed cruising is inputted. The shift change period setting switch 122 outputs a signal indicating the time period of changing or switching the shift position set by the operator. The throttle opening setting switch 124 outputs a signal indicating the desired throttle opening set by the operator at the low-speed cruising, more precisely the throttle opening at the in-gear position in the low-speed cruising. The outputs of the low-speed cruising switch 120, shift change period setting switch 122 and throttle opening setting switch 124 are sent to the ECU 26.

Based on the outputs of the switches 120, 122 and 124, the ECU 26 controls the thrust or propelling force produced by the propeller 32 so as to regulate the boat speed. Specifically, the ECU 26 implements a throttle control to operate the electric throttle motor 36 so as to move the throttle valve 74 to the set desired throttle opening, and a shift control to operate the electric shift motor 38 to change or switch the shift position in response to the set time period.

Figure 5:
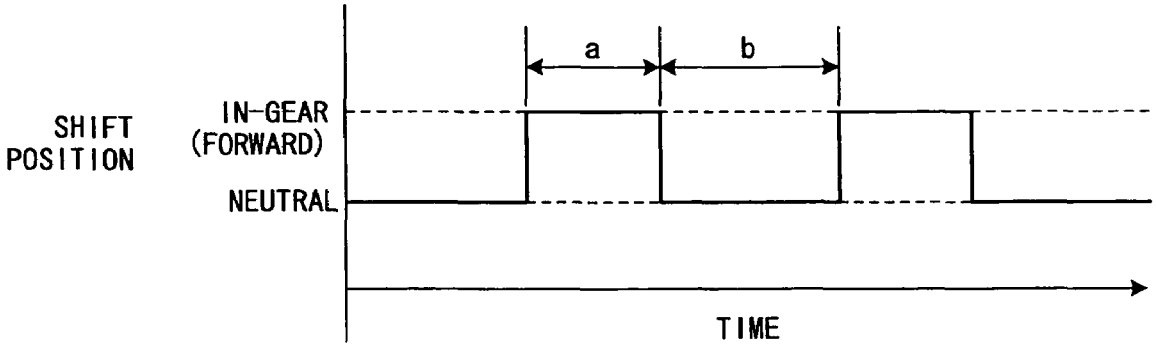
FIG. 5 is a time chart showing a shift control of the system shown in FIG. 4.

FIG. 5 is a time chart showing this shift control mentioned above.

As shown in FIG. 5, when the instruction to implement the low-speed cruising is inputted through the low-speed cruising switch 120, the ECU 26 controls the operation of the electric shift motor 38 to operate the shift mechanism to establish the in-gear (forward) position and neutral alternatively.

The time period of in-gear position (designated "a" in the figure; indicating a period of time during which the in-gear position should be held) and that of the neutral position (designated "b" in the figure; indicating a period of time during which the neutral should be held) are set in accordance with the output of the shift change period setting switch 122. In other words, the time periods for changing shift position can be set as desired by the operator using the shift change period setting switch 122. Further, the throttle opening during the in-gear operation can be set as desired by the operator using the throttle opening setting switch 124.

As a result, the speed of the boat 12 can be regulated as desired by manipulating the shift change period setting switch 122 and throttle opening setting switch 124. For example, the boat speed can be automatically increased by manipulating the throttle opening setting switch 124 to increase the throttle opening (raise the engine speed) and manipulating the shift change period setting switch 122 to shorten the time period to hold the neutral position (in other words, to lengthen the time period to hold the in-gear position).

Conversely, the boat speed can be automatically decreased by manipulating the throttle opening setting switch 124 to decrease the throttle opening (lower the engine speed) and manipulating the shift change period setting switch 122 to lengthen the time period to hold the neutral position (in other words, to shorten the time period to hold the in-gear position).

Very slow-speed cruising can therefore be achieved by manipulating the throttle opening setting switch 124 to set the engine speed at, for example, an idling speed (minimum speed) and concurrently manipulating the shift change period setting switch 122 to set the time period for changing the shift position appropriately.

As explained in the foregoing, the outboard motor control system according to the first embodiment of the invention is equipped with the electric throttle motor 36 for opening and closing the throttle valve 74 of the engine 28, the electric shift motor 38 for operating the shift mechanism of the outboard motor 10 to establish either the in-gear or neutral shift position, and the low-speed cruising switch 120 for inputting the instruction to implement the low-speed cruising for causing the boat 12 to cruise at a low speed, and is configured so that when the instruction to implement the low-speed cruising is inputted, the throttle control is effected by controlling the operation of the electric throttle motor 36 to the set throttle opening and shift control is effected by controlling the operation of the electric shift motor 38 to operate the shift mechanism to establish the in-gear position and neutral position alternatively. The outboard motor control system according to the first embodiment of the invention therefore enables cruising over a wide range of speeds including very slow, without requiring troublesome manual operations.

Further, the boat speed can be set as desired because the time period of changing the shift position between the in-gear position and neutral is set as desired by the shift change period setting switch 122. Moreover, improved convenience is realized by enabling boat speed regulation not only by ordinary throttle operation (manipulation of the throttle lever 110) but also by operation of the shift change period setting switch 122 and/or throttle opening setting switch 124.

An outboard motor control system in accordance with a second embodiment of the invention will now be explained.

Figure 6:
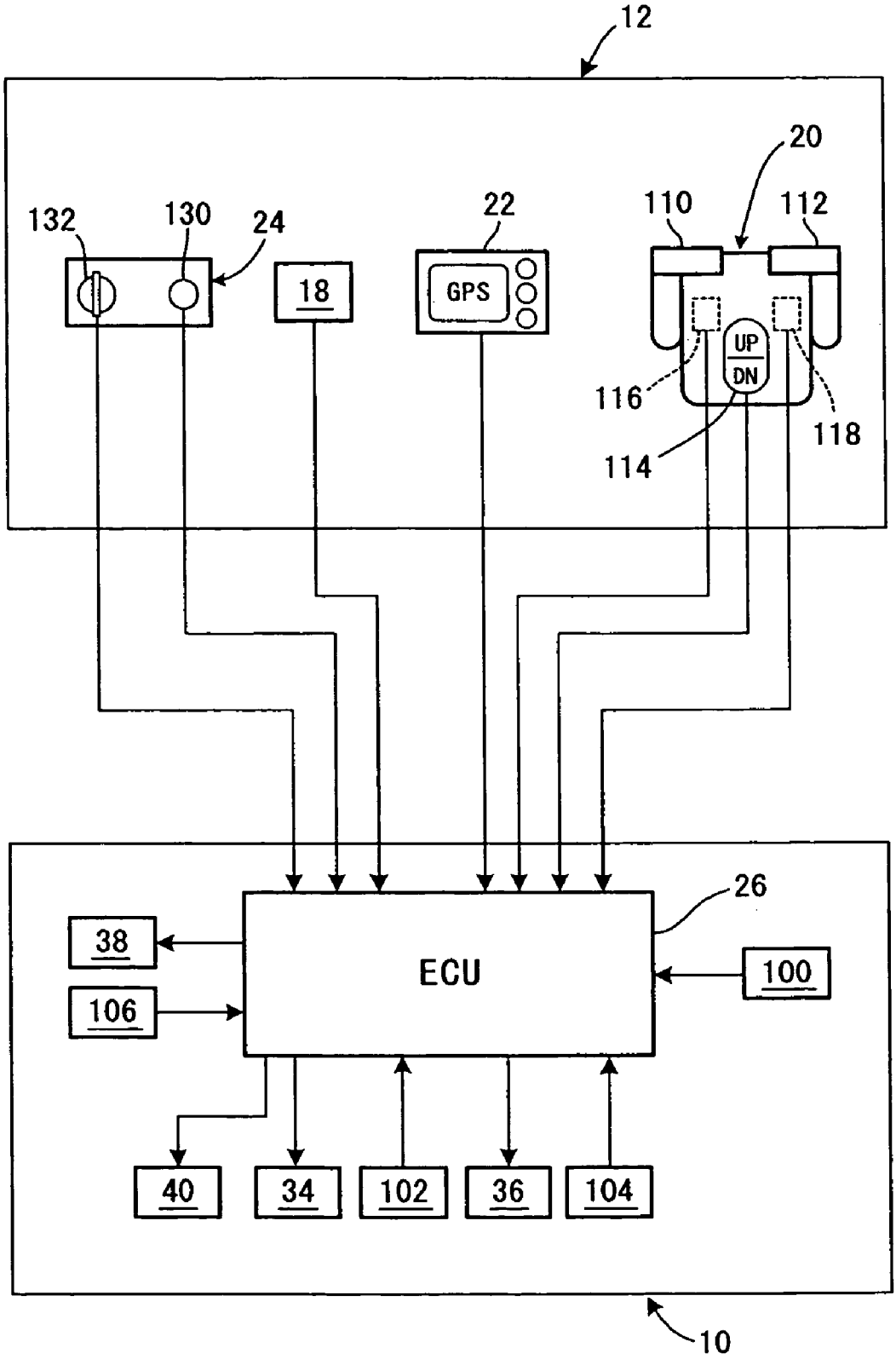
FIG. 6 is a block diagram, similar to FIG. 4, but showing an outboard motor control system according to a second embodiment of the invention.

FIG. 6 is a block diagram, similar to FIG. 4, but showing the configuration of the outboard motor control system according to the second embodiment.

As shown in FIG. 6, in the second embodiment, the low-speed cruising switch 120, shift change period setting switch 122 and throttle opening setting switch 124 provided in the control panel 24 in the first embodiment are replaced with a constant-speed cruising switch (instruction switch) 130 for enabling the operator to input an instruction to implement a constant-speed cruising for causing the boat 12 to cruise at a constant low speed and a boat speed setting switch (dial switch) 132 for enabling the operator to set the boat speed at the constant-low-speed cruising.

When operated or manipulated by the operator, the constant-speed cruising switch 130 outputs a signal indicating that the instruction to implement the constant-low-speed cruising is inputted. The boat speed setting switch 132 outputs a signal indicating a boat speed (hereinafter called "set speed V0") corresponding to the switch position manipulated by the operator (i.e., the position dialed by the operator). The outputs of the constant-speed cruising switch 130 and boat speed setting 132 are sent to the ECU 26.

The boat speed detected (calculated) by a GPS 22 (hereinafter called "boat speed V") is sent to the ECU 26. Based on the outputs of the switches 130, 132 and the detected boat speed V, the ECU 26 controls the thrust or propelling force produced by the propeller 32 so as to regulate the boat speed. Specifically, the ECU 26 implements a throttle control and a shift control such that the detected boat speed V becomes equal to the set boat speed V0.

Figure 7:
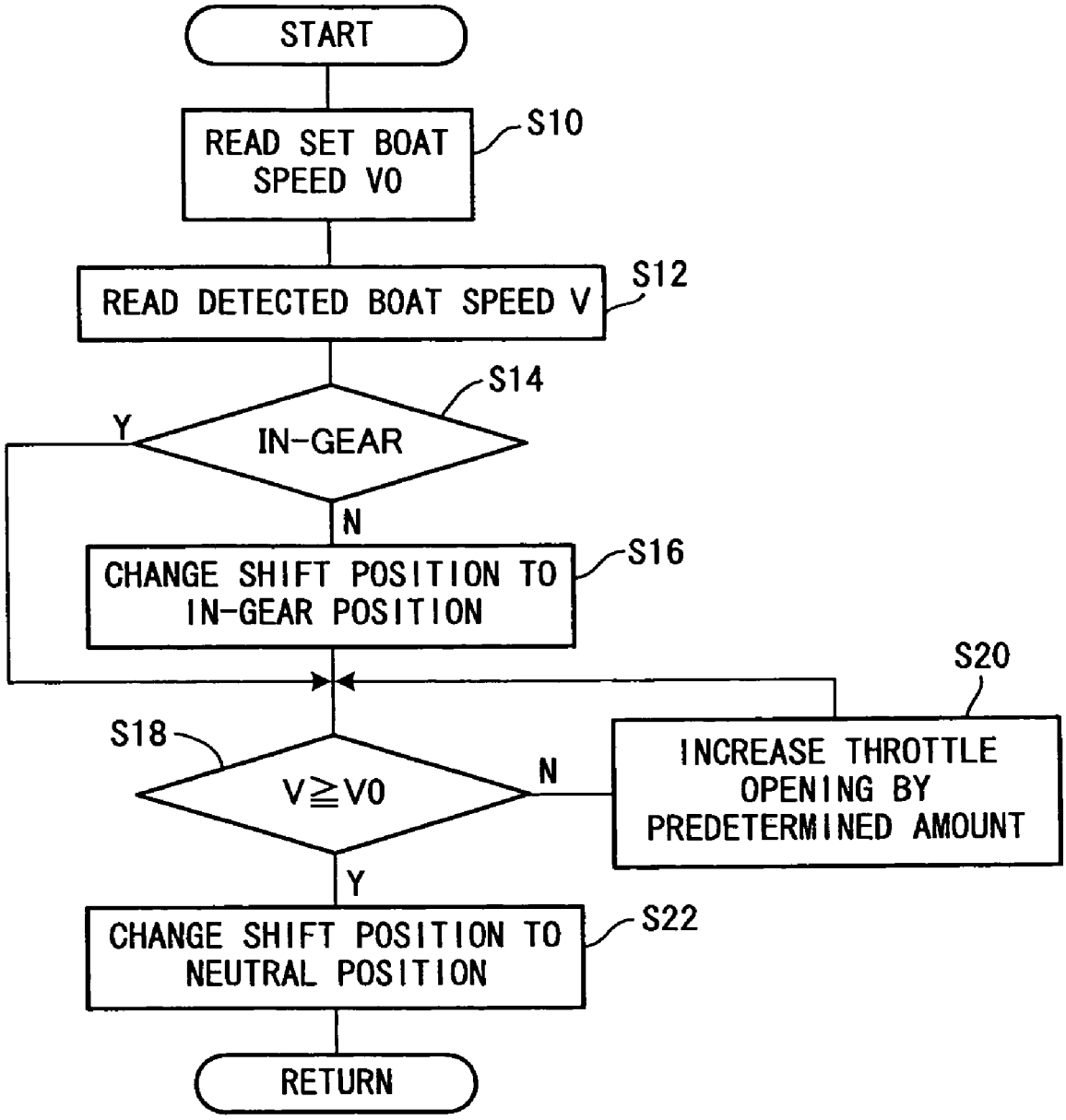
FIG. 7 is a flowchart showing an operation of the system shown in FIG. 6.

FIG. 7 is a flow chart showing the sequence of throttle control and shift control operations in the second embodiment. The routine of this flowchart is executed when the instruction to implement the constant-low-speed cruising is inputted from the constant-speed cruising switch 130.

Explaining this, the set boat speed V0 (desired speed) is read in S10, whereafter the detected (current) boat speed V is read in S12. Next, in S14, it is checked whether the shift position is in-gear (forward) position.

When the result in S14 is No, the program goes to S16, in which the shift position is changed to the in-gear position. In other words, the electric shift motor 38 is controlled to operate the shift mechanism to establish the in-gear position. When the result in S14 is Yes, S16 is skipped.

Next, in S18, it is checked whether the detected (current) boat speed V is equal to or greater than the set speed V0. When the result in S18 is No, i.e., when the detected boat speed V is less than the set speed V0, the program goes to S20, in which the throttle opening is increased by a predetermined amount. In other words, the operation of the electric throttle motor 36 is controlled to increase the engine speed by a predetermined number of revolutions.

After the throttle opening has been increased in S20, the program returns to S18. The engine speed is repeatedly increased until the boat speed V becomes equal to or greater than the set speed V0 and the result in S18 becomes Yes, whereafter the program goes to S22, in which the shift position is changed to the neutral position, in other words, the electric shift motor 38 is controlled to operate the shift mechanism to establish the neutral position.

The other aspects of second embodiment are not explained here because they are the same as those of the first embodiment.

As explained in the foregoing, the outboard motor control system according to the second embodiment of the invention is equipped with the GPS 22 for detecting the boat speed V and the constant-speed cruising switch 130 for inputting the instruction to implement the constant-low-speed cruising for causing the boat 12 to cruise at constant low speed, and is configured so that when the instruction to implement the constant-low-speed cruising is inputted, the throttle control and the shift control are implemented to change the shift position between the in-gear position and neutral position such that the detected boat speed V becomes equal to the set speed V0.

The outboard motor control system according to the second embodiment of the invention therefore enables cruising over a wide range of speeds including very slow, without requiring the operator's troublesome manual operations. It also enables regulation of the boat speed to the desired speed with high accuracy.

Moreover, improved convenience is realized by enabling boat speed regulation not only by ordinary throttle operation (manipulation of the throttle lever 110) but also by operation of the speed setting switch 132.

The first and second embodiments are thus configured to have a system for controlling an outboard motor (10) mounted on a stern of a boat (12) and having an internal combustion engine (28) and a propeller (32) that is powered by the engine to propel the boat, comprising: a throttle actuator (electric throttle motor 36) connected to a throttle valve (74) of the engine and moving the throttle valve; a shift actuator (electric shift motor 38) connected to a shift mechanism (clutch 90, shift rod 92 and shift slider 94) of the outboard motor and operating the shift mechanism to establish one from among a neutral position, an in-gear position and a reverse position; an instruction switch (low-speed cruising switch 120; constant-speed cruising switch 130) enabling an operator to input an instruction to cause the boat to cruise at a low speed; and a control unit (ECU 26) controlling operations of the throttle actuator and the shift actuator, when the instruction switch is manipulated by the operator, such that shift position is changed alternatively between the neutral position and the in-gear position. It will be understood that when the instruction switch 120 is once manipulated by the operator, the shift position is automatically changed alternatively between the neutral position and the in-gear position.

With this, the outboard motor control system therefore enables cruising over a wide range of speeds including very slow, without requiring an operator's troublesome manual operations.

The system further includes: a shift change period setting switch (122) enabling the operator to set time periods (a, b) during which the in-gear position and the neutral position are to be held before the shift position is changed therebetween; a throttle opening setting switch (124) enabling the operator to set a desired throttle opening at the in-gear position; and the control unit (ECU 26) controls the operation of the shift actuator such that the shift position is changed between the in-gear position and the neutral position after the set time period corresponding thereto has expired, while controlling the operation of the throttle actuator such that the throttle opening becomes equal to the desired throttle opening when the shift position is held at the in-gear position.

The system further includes; a boat speed setting switch (132) enabling the operator to set a desired speed of the boat; and a boat speed detector (GPS 22) detecting a speed of the boat; and the control unit (ECU 26; S10 to S22) controls the operations of the throttle actuator and the shift actuator in such a way that shift position is changed alternatively between the neutral position and the in-gear position, such that the detected boat speed becomes equal to the set boat speed. With this, the outboard motor control system therefore enables cruising over a wide range of speeds including very slow, without requiring operator's troublesome manual operations. It also enables regulation of the boat speed to the desired speed with high accuracy.

In the system, the control unit (ECU 26; S18, S20) controls the operation of the throttle actuator to increase the throttle opening when the detected boat speed is less than the set boat speed. With this, the configuration improves convenience by enabling boat speed regulation not only by ordinary throttle operation but also by operation of the set speed changing.

It should be noted in the above that, although the first embodiment is focused on achieving low-speed cruising and the second embodiment on achieving constant-speed cruising, it is also possible to configure a single system capable of achieving both low-speed cruising and constant-speed cruising. A so-configured outboard motor control system could be utilized differently according to purpose by, for example, selecting the constant-speed cruising when cruising dead slow in a harbor and, on the other hand, alternately repeating quick and dead-slow cruising during trolling by selecting the low-speed cruising and appropriately setting the shift change period and the throttle opening during in-gear operation.

It should further be noted that, although it has been explained that the boat speed V is detected by the GPS 22, it can instead be detected using a water speed sensor or the like.

Japanese Patent Application No. 2004-199090 filed on Jul. 6, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling an outboard motor adapted to be mounted on a stem of a boat and having an internal combustion engine and a propeller that is powered by the engine to propel the boat, comprising:

a throttle actuator connected to a throttle valve of the engine and moving the throttle valve;

a shift actuator connected to a shift mechanism of the outboard motor and operating the shift mechanism to establish one from among a neutral position, an in-gear position and a reverse position;

an instruction switch enabling an operator to input an instruction to cause the boat to cruise at a low speed; and a control unit which operably controls operations of the throttle actuator and the shift actuator, when the instruction switch is once manipulated by the operator, such that shift position is automatically changed alternatively between the neutral position and the in-gear position.

2. The system for controlling an outboard motor adapted to be mounted on a stern of a boat and having an internal combustion engine and a propeller that is powered by the engine to propel the boat, comprising:

a throttle actuator connected to a throttle valve of the engine and moving the throttle valve;

a shift actuator connected to a shift mechanism of the outboard motor and operating the shift mechanism to establish one from among a neutral position, an in-gear position and a reverse position;

an instruction switch enabling an operator to input an instruction to cause the boat to cruise at a low speed;

a control unit which operably controls operations of the throttle actuator and the shift actuator, when the instruction switch is manipulated by the operator, such that shift position is changed alternatively between the neutral position and the in-gear position;

a shift change period setting switch enabling the operator to set time periods during which the in-gear position and the neutral position are to be held before the shift position is changed therebetween; and a throttle opening setting switch enabling the operator to set a desired throttle opening at the in-gear position;

wherein the control unit controls the operation of the shift actuator such that the shift position is changed between the in-gear position and the neutral position after the set time period corresponding thereto has expired, while controlling the operation of the throttle actuator such that the throttle opening becomes equal to the desired throttle opening when the shift position is held at the in-gear position.

3. The system for controlling an outboard motor adapted to be mounted on a stern of a boat and having an internal combustion engine and a propeller that is powered by the engine to propel the boat, comprising:

a throttle actuator connected to a throttle valve of the engine and moving the throttle valve;

a shift actuator connected to a shift mechanism of the outboard motor and operating the shift mechanism to establish one from among a neutral position, an in-gear position and a reverse position;

an instruction switch enabling an operator to input an instruction to cause the boat to cruise at a low speed;

a control unit which operably controls operations of the throttle actuator and the shift actuator, when the instruction switch is manipulated by the operator, such that shift position is changed alternatively between the neutral position and the in-gear position;

a boat speed setting switch enabling the operator to set a desired speed of the boat; and a boat speed detector detecting a speed of the boat;

wherein the control unit controls the operations of the throttle actuator and the shift actuator in such a way that the shift position is changed alternatively between the neutral position and the in-gear position, such that the detected boat speed becomes equal to the set boat speed.

4. The system according to claim 3, wherein the control unit controls the operation of the throttle actuator to increase the throttle opening when the detected boat speed is less than the set boat speed.

5. A method of controlling an outboard motor mounted on a stern of a boat and having an internal combustion engine, a propeller that is powered by the engine to propel the boat, a throttle actuator connected to a throttle valve of the engine and moving the throttle valve, a shift actuator connected to a shift mechanism of the outboard motor and operating the shift mechanism to establish one from among a neutral position, an in-gear position and a reverse position, and an instruction switch enabling an operator to input an instruction to cause the boat to cruise at a low speed, comprising the step of:

controlling operations of the throttle actuator and the shift actuator, when the instruction switch is once manipulated by the operator, such that shift position is automatically changed alternatively between the neutral position and the in-gear position.

6. A method of controlling an outboard motor mounted on a stern of a boat and having an internal combustion engine, a propeller that is powered by the engine to propel the boat, a throttle actuator connected to a throttle valve of the engine and moving the throttle valve, a shift actuator connected to a shift mechanism of the outboard motor and operating the shift mechanism to establish one from among a neutral position, an in-gear position and a reverse position, and an instruction switch enabling an operator to input an instruction to cause the boat to cruise at a low speed, comprising the steps of:

(a) controlling operations of the throttle actuator and the shift actuator, when the instruction switch is manipulated by the operator, such that shift position is changed alternatively between the neutral position and the in-gear position;

(b) providing a shift change period setting switch enabling the operator to set time periods during which the in-gear position and the neutral position are to be held before the shift position is changed therebetween; and (c) providing a throttle opening setting switch enabling the operator to set a desired throttle opening at the in-gear position;

wherein the step (a) controls the operation of the shift actuator such that the shift position is changed between the in-gear position and the neutral position after the set time period corresponding thereto has expired, while controlling the operation of the throttle actuator such that the throttle opening becomes equal to the desired throttle opening when the shift position is held at the in-gear position.

7. A method of controlling an outboard motor mounted on a stern of a boat and having an internal combustion engine, a propeller that is powered by the engine to propel the boat, a throttle actuator connected to a throttle valve of the engine and moving the throttle valve, a shift actuator connected to a shift mechanism of the outboard motor and operating the shift mechanism to establish one from among a neutral position, an in-gear position and a reverse position, and an instruction switch enabling an operator to input an instruction to cause the boat to cruise at a low speed, comprising the steps of:

(a) controlling operations of the throttle actuator and the shift actuator, when the instruction switch is manipulated by the operator, such that shift position is changed alternatively between the neutral position and the in-gear position;

(b) providing a boat speed setting switch enabling the operator to set a desired speed of the boat; and (c) detecting a speed of the boat;

wherein the step (a) controls the operations of the throttle actuator and the shift actuator in such a way that the shift position is changed alternatively between the neutral position and the in-gear position, such that the detected boat speed becomes equal to the set boat speed.

8. The method according to claim 7, wherein the step (a) controls the operation of the throttle actuator to increase the throttle opening when the detected boat speed is less than the set boat speed.

* * * * *